US007547670B2

(12) United States Patent
Gross et al.

(10) Patent No.: US 7,547,670 B2
(45) Date of Patent: Jun. 16, 2009

(54) LOW ODOR ESTER-BASED MICROEMULSIONS FOR CLEANING HARD SURFACES

(75) Inventors: Stephen F. Gross, Souderton, PA (US); Markus Doerr, Glenmoore, PA (US); Timothy C. Morris, Morton, PA (US)

(73) Assignee: Cognis IP Management GmbH, Dusseldorf (DE)

( * ) Notice: Subject to any disclaimer, the term of this patent is extended or adjusted under 35 U.S.C. 154(b) by 257 days.

(21) Appl. No.: 11/524,147

(22) Filed: Sep. 20, 2006

(65) Prior Publication Data

US 2007/0093404 A1 Apr. 26, 2007

Related U.S. Application Data

(60) Provisional application No. 60/730,055, filed on Oct. 25, 2005.

(51) Int. Cl.
*C11D 1/22* (2006.01)
*C11D 3/44* (2006.01)

(52) U.S. Cl. ..... 510/197; 510/234; 510/365; 510/417; 510/426; 510/427; 510/428; 510/432; 510/525

(58) Field of Classification Search ..... 510/197, 510/234, 365, 417, 426, 427, 428, 432, 525
See application file for complete search history.

(56) References Cited

U.S. PATENT DOCUMENTS

| | | | | | |
|---|---|---|---|---|---|
| 4,092,273 | A * | 5/1978 | Inamorato et al. | ..... | 510/340 |
| 4,673,524 | A * | 6/1987 | Dean | ..... | 510/413 |
| 5,158,710 | A * | 10/1992 | VanEenam | ..... | 510/264 |
| 5,518,661 | A * | 5/1996 | Langford et al. | ..... | 252/364 |
| 5,952,287 | A | 9/1999 | Gross et al. | | |
| 6,224,685 | B1 | 5/2001 | Gross et al. | | |
| 6,255,269 | B1 * | 7/2001 | Leonard et al. | ..... | 510/238 |
| 6,368,358 | B1 | 4/2002 | Glenn et al. | | |
| 6,403,546 | B1 * | 6/2002 | Hernandez et al. | ..... | 510/214 |
| 6,706,676 | B2 * | 3/2004 | Swensen | ..... | 510/174 |
| 7,309,684 | B2 * | 12/2007 | Filippini et al. | ..... | 510/201 |

* cited by examiner

*Primary Examiner*—Charles I Boyer

(57) ABSTRACT

Disclosed is a hard surface cleaning composition employing dibasic esters as a primary solvent in combination with a primary emulsifier, a short-chain cosurfactant, a secondary emulsifier and water. Optional components include a polar solvent and a thickener. The disclosed composition is preferably in the form of an oil continuous microemulsion and is provided as a component of a liquid or spray formulation for use, depending upon the application. The disclosed cleaning agents have a low odor and satisfy the 2005 CARB VOC requirements of less than 8% by weight for oven cleaners.

27 Claims, No Drawings

LOW ODOR ESTER-BASED MICROEMULSIONS FOR CLEANING HARD SURFACES

CROSS-REFERENCE TO RELATED APPLICATIONS

This application claims priority under 35 U.S.C. §-119(e) from provisional U.S. Patent Application No. 60/730,055, filed on Oct. 25, 2005.

STATEMENT REGARDING FEDERALLY SPONSORED RESEARCH OR DEVELOPMENT

Not applicable.

BACKGROUND OF THE INVENTION

The present invention relates to a novel cleaning composition having superior cleaning ability which is readily biodegradable, low in toxicity and volatility, neutral in pH and primarily naturally derived. More particularly, the invention relates to a highly effective hard surface cleaning composition having a low odor and to oven cleaning compositions having a low odor and a low VOC content of less than 8% by weight.

U.S. Pat. Nos. 5,952,287 and 6,224,685 disclose terpene-free hard surface cleaning compositions containing: (a) from about 0.2 to about 10% by weight of a nonionic surfactant; (b) from about 0.5 to about 10% by weight of an anionic surfactant; (c) from about 3 to about 90% by weight of a primary solvent consisting of a $C_6$-$C_{14}$ methyl ester; (d) from about 0.5 to about 10% by weight of a short-chain cosurfactant; and (e) remainder, water, all weights being based on the total weight of the composition. The disclosed compositions are exemplified in the form of microemulsions. Two drawbacks of these methyl ester compositions are their relatively high volatility and unacceptable odor, particularly for indoor, confined space or higher temperature use.

U.S. Pat. No. 6,368,358 discloses the use of dibasic esters in compositions to inhibit color degradation caused by oxidation on synthetic textile substrates. The disclosed antioxidant compositions contain: (a) an antioxidant component; (b) a dibasic ester solvent; (c) a surfactant component; and (d) optionally, water.

One problem to be solved with respect to the presently disclosed invention, however, was to provide a more effective hard surface cleaning agent, particularly for difficult to clean surfaces such as pots and pans having baked on or burnt on grease and food substances, including for high temperature uses such as in self-cleaning ovens. Another problem to be solved by the present invention was to provide such a cleaning agent which would meet the 2005 CARB VOC limits and also have a minimal odor.

BRIEF SUMMARY OF THE INVENTION

It has been surprisingly discovered that the superior cleaning and low VOC objects of the invention can be accomplished simultaneously by providing a hard surface cleaning composition employing dibasic esters as a primary solvent in combination with a primary emulsifier, a short-chain cosurfactant, and a secondary emulsifier in water. Optional components include a thickener. The disclosed composition is in the form of an oil-continuous microemulsion and is provided as a liquid or spray formulation for use, depending upon the application.

The present invention is also directed to a process for cleaning a hard surface substrate involving contacting the substrate with a cleaning-effective amount of the above-disclosed dibasic ester cleaning compositions.

BRIEF DESCRIPTION OF THE SEVERAL VIEWS OF THE DRAWING

Not applicable.

DETAILED DESCRIPTION OF THE INVENTION

Other than in the operating examples, or where otherwise indicated, all numbers expressing quantities of ingredients or reaction conditions used herein are to be understood as being modified in all instances by the term "about".

More particularly, the dibasic ester cleaning composition of the invention comprises (a) from 1 to 15%, preferably 7 to 10%, by weight, of a primary emulsifier;
(b) from 3 to 50%, preferably 18 to 22%, by weight, of a primary solvent selected from one or more dibasic esters;
(c) from 1 to 20%, preferably 7 to 18%, and most preferably 7 to 10%, by weight, of one or more short-chain cosurfactants;
(d) from 1 to 5%, preferably 1.9 to 3.6%, by weight, of a secondary emulsifier; and
(e) remainder to 100% of water, all weights being based on the total weight of the composition.

These compositions are preferably in the form of microemulsions and are preferably terpene free.

The compositions may further contain from 1 to 15%, preferably from 5 to 10%, by weight of a polar solvent and from about 0.1 to about 1.0%, preferably 0.3 to 0.5%, by weight, of a thickening agent, based on the weight of the composition.

The invention further provides such a composition particularly for oven cleaning and having a calculated VOC of less than 8% (by weight).

Suitable primary emulsifiers for use in the present invention include the salts of a $C_{10-14}$ alkyl benzene sulfonic acid. A preferred primary emulsifier is an isopropylamine salt of a linear alkylbenzene sulfonic acid. A particularly preferred primary emulsifier is an isopropylamine salt of alkyl sulfonic acid formed by reacting isopropylamine with alkyl sulfonic acid, in a ratio by weight of from about 1:4, to about 1:6, and most preferably from about 1:5, resulting in complete neutralization of the alkyl sulfonic acid.

The primary solvent used in the present invention is selected from dibasic esters. Dibasic esters are generally defined as dialkyl esters of dicarboxylic acids capable of undergoing reactions at the ester group, including both hydrolysis and saponification. The acid portion of the dibasic ester may be derived from such dibasic acids such as, adipic, glutaric, oxalic, malonic, pimelic, suberic and azelaic acids, as well as mixtures thereof.

Examples of suitable dibasic esters for use in the present invention include, but are not limited to, dimethyl adipate, dimethyl glutarate, and mixtures thereof. A particularly preferred dibasic ester is a mixture of dimethyl adipate, and dimethyl glutarate, commercially available as DBE-LVP from Invista Corp.

Suitable short-chain co-surfactants for use in the present invention include, but are not limited to, $C_2$-$C_5$ alcohols, glycols, glycol ethers (including ethylene or propylene glycol phenyl ethers) pyrrolidones and glycol ether esters. Particularly preferred short-chain cosurfactants are propylene glycol n-butyl ether, dipropylene glycol n-butyl ether, and mixtures thereof.

Suitable secondary emulsifiers for use in the invention are selected from surfactants having high water solubility. Such surfactants include, but are not limited to, sodium octyl sulfate (most preferred), sodium decyl sulfate, sodium lauryl sulfate, alcohol ether sulfates, octyl polyglucoside, decyl polyglucoside, alcohol ethoxylates having HLB values >14, and mixtures of the above.

A polar solvent may be added to the composition of the invention in order to further facilitate the removal of the undesirable materials from the surface to be cleaned. Suitable polar solvents for use in the present invention include those having a water solubility of from about 1 to about 8 g/100 ml, preferably from about 1 to about 5 g/100 ml, and most preferably from about 2 to about 3 g/100 ml. Examples thereof include, but are not limited to, benzyl alcohol, propylene glycol n-butyl ether, n-hexanol, glycol phenyl ethers, and mixtures thereof. A particularly preferred polar solvent is benzyl alcohol. When used, the polar solvent is present in the amount of 1 to 15%, preferably in the amount of 5 to 10%, based on the weight of the composition.

The removal of undesirable aged paints, coatings, greases, and the like from various substrates is accomplished by two mechanisms, namely, dissolution and lifting. Dissolution occurs when the undesirable material is dissolved from the substrate by a solvent. Lifting occurs when the solvent penetrates into the undesirable material and causes it to swell. As a result of the swelling, the material, whether it be a paint, coating or the like, wrinkles and lifts (separates) from the substrate, allowing it to then be easily removed from the substrate's surface.

The removal of such undesirable materials from vertical substrates may require the use of a cleaning composition capable of vertical surface cling. The dibasic ester compositions of the invention, in particular as microemulsions and free of terpenes, can be formulated for more effective vertical surface cling by adding an effective amount of certain thickeners and polar solvents to the microemulsion.

In order to make suitable microemulsions incorporating the thickening agents, the solvent phase is first made more polar by replacing a portion of the alkyl ester with a more polar solvent such as, for example, benzyl alcohol, ethylene glycol phenyl ether, propylene glycol phenyl ether, 1-hexanol, and mixtures thereof. This alone, however does not facilitate complete solubility of the cellulosic gum thickener in the finished microemulsion. It is also necessary to increase the amount of the aqueous internal phase, thereby decreasing the amount of continuous solvent phase. These measures result in both the complete solubility of the cellulosic gum thickener in the finished microemulsion, as well as a reduction in the total amount of emulsifiers required to form a stable microemulsion.

Suitable optional thickening agents which may be employed by the present invention are, in general, low viscosity polymers. Examples thereof include methyl cellulose (MC), microcrystalline cellulose (MCC), povidone (PVP), pre-gelatinized starch (Starch), hydroxypropyl cellulose (HPC), hydroxypropyl methylcellulose (HPMC), and combinations thereof. Colloidal fused silicas and hydrophobically modified clays are also suitable particulate thickeners. Particularly preferred thickeners are hydroxypropyl cellulose, hydroxypropyl methylcellulose, and mixtures thereof. When used, the thickening agent is present in the amount 0.1 to 1%, preferably in the amount of 0.3 to 0.5%, based on the weight of the composition.

Since dibasic esters are subject to hydrolysis under alkaline conditions, it is imperative that the pH of the hard-surface cleaning composition be less than about 9, and preferably in the range of from about 4 to about 8.

The dibasic ester cleaning compositions of the present invention are in the form of microemulsions, in particular as oil continuous microemulsions, which provides a further advantage of a high level of thermal stability, that is, at temperatures ranging from about 10 to about 70° C. However, in order to achieve this level of thermal stability, the ratio by weight of dibasic ester:water in the composition is from about 1:5 to 1:1, preferably from about 1:2 to 1:2.5.

Auxiliaries may be incorporated into the cleaning composition of the present invention without departing from the spirit thereof. Examples of suitable auxiliaries which may be used include, but are not limited to, amphoteric surfactants, zwitterionic surfactants, pH buffering agents, corrosion inhibitors, dyes, perfumes, enzymes, preservatives, hydrotropes, and the like.

According to another embodiment of the present invention, there is provided a process for cleaning a hard surface involving contacting the hard surface with the above-disclosed composition.

The cleaning compositions according to the invention can be used in a wide variety of applications which include, but are not limited to, the removal of grease, oil, ink, chewing gum and paint from hard and porous surfaces including all kinds of natural and synthetic fabrics in both industrial-institutional and consumer applications. Examples of the disparate types of applications include, but are not limited to, the use of the cleaning compositions according to the invention as water rinsable paint brush cleaners for brushes having both natural and synthetic bristles. Another use is as a cleaner for human skin and nails such as hand and finger nail cleaner for the removal of paints, greases, glues, nail polish and the like. The cleaning compositions according to the invention can also be used as a spot cleaner for removing grease, oil and paints from carpets and rugs and as a prespotter in laundry applications for the removal of stains from fabrics. Other applications include the removal of grease such as lithium and molybdenum greases from steel and concrete surfaces such as, for example, wheel bearings or garage floors having grease and oil stained tire tracks and the like. The cleaning compositions according to the invention can also be used to clean the concrete and metal surfaces of off-shore oil drilling platforms.

EXAMPLES

The present invention will be better understood by the examples which follow, all of which are intended for illustrative purposes only, and are not meant to unduly limit the scope of the invention in any way. Unless otherwise indicated, percentages are on a weight-by-weight basis.

Example 1

A low VOC dibasic ester microemulsion cleaning composition was prepared by combining the components listed below in the order shown with moderate agitation:

Optionally a suitable thickener such as hydroxy propyl methyl cellulose or fused silica may be added. Cellulosic thickeners must be added to the water and completely hydrated before adding the remaining ingredients, while particulate thickeners may be post-added to the finished microemulsion. The product is a liquid which may be sprayed if desired and has a calculated VOC of 7.5%.

| Component | % wt. |
|---|---|
| a) water | 49.5 |
| b) Short chain co-surfactant - dipropylene glycol n-butyl ether (DPnB) | 9.0 |
| c) Short chain co-surfactant - propylene glycol n-butyl ether (PnB) | 7.5 |
| d) Primary emulsifier (oil soluble) - isopropylamine salt of LAS acid (PRS) | 9.0 |
| e) Secondary emulsifier (water soluble) - Na n-octyl sulfate (T-842, 42%) | 4.0 |
| f) Dibasic Ester - mixture of dimethyl adipate and glutarate (DBE-LVP) | 21.0 |
| | 100.0 |

| Source | |
|---|---|
| Dowanol (TM) DPnB = | dipropylene glycol n-butyl ether |
| Dowanol (TM) PnB = | propylene glycol n-butyl ether |
| Calimulse (TM) PRS = | Isopropyl Amine Salt of Linear alkyl benzene sulfonic acid |
| Texapon ® 842 = | sodium n-octyl sulfate, 42% |
| Invista (TM) DBE-LV = | Dibasic esters (86% dimethyl adipate, 14% dimethyl glutarate) |

Example 2

A low VOC dibasic ester microemulsion cleaning composition was prepared by combining the components listed below in the order shown with moderate agitation: Optionally a suitable thickener such as hydroxy propyl methyl cellulose or fused silica may be added. Cellulosic thickeners must be added to the water and completely hydrated before adding the remaining ingredients, while particulate thickeners may be post-added to the finished microemulsion. The product is a liquid which may be sprayed if desired and has a calculated VOC of 7.5%.

| Component | % wt. |
|---|---|
| a) Water | 44.7 |
| b) Short chain co-surfactant - dipropylene glycol n-butyl ether (DPnB) | 9.0 |
| c) Polar solvent - benzyl alcohol | 7.5 |
| d) Primary emulsifier (oil soluble) - isopropylamine salt of LAS acid (PRS) | 9.2 |
| e) Secondary emulsifier (water soluble) - Na n-octyl sulfate (T-842, 42%) | 8.6 |
| f) Dibasic Ester - mixture of dimethyl adipate, and glutarate DBE-LVP) | 21.0 |
| | 100.0 |

What is claimed is:

1. A microemulsion composition comprising:

(a) from about 1 to about 15% by weight of a primary emulsifier comprising at least one isopropylamine salt of a $C_{10-14}$ alkylbenzenesulfonic acid;

(b) from about 3 to about 50% by weight of a primary solvent selected from one or more dibasic esters;

(c) from about 1 to about 20% by weight of one or more short-chain cosurfactants comprising at least n-butyl ether of a propylene glycol;

(d) from about 1 to about 5% by weight of secondary emulsifier; and (e) the remainder, water to 100%, all weights being based on the total weight of the composition.

2. The composition of claim 1 wherein the composition is terpene-free.

3. The composition of claim 1 wherein the primary emulsifier is present in the composition in an amount of from about 7 to about 10% by weight.

4. The composition of claim 1 wherein the primary emulsifier further comprises one or more additional salts of a $C_{10-14}$ alkyl benzene sulfonic acid.

5. The composition of claim 1 wherein the primary solvent is present in the composition in an amount of from about 18.0 to about 22.0% by weight.

6. The composition of claim 1 wherein the one or more dibasic esters of the primary solvent are selected from C1-4 dialkyl esters of adipic, glutaric, oxalic, malonic, pimelic, suberic or azelaic acids, or mixtures of these acids.

7. The composition of claim 6 wherein the one or more dibasic esters are methyl esters.

8. The composition of claim 1 wherein the primary solvent is selected from dimethyladipate, dimethyl glutarate, and mixtures thereof.

9. The composition of claim 1 wherein the short chain co-surfactant is present in the composition in an amount of from about 7 to about 18% by weight.

10. The composition of claim 1 wherein the short-chain co-surfactant is propylene glycol n-butyl ether or dipropylene glycol n-butyl ether or a mixture thereof.

11. The composition of claim 1 wherein the secondary emulsifier is present in the composition in an amount of from about 1.9 to about 3.6% by weight.

12. The composition of claim 1 wherein the secondary emulsifier comprises surfactants having high water solubility.

13. The composition of claim 1 wherein the secondary emulsifier is selected from the group consisting of sodium octyl sulfate, sodium decyl sulfate, sodium lauryl sulfate, alcohol ether sulfates, octyl polyglucoside, decyl polyglucoside, alcohol ethoxylates having HLB values greater than 14, and mixtures thereof.

14. The composition of claim 13 wherein the secondary emulsifier is sodium n-octyl sulfate.

15. The composition of claim 1, further comprising from about 1 to about 15% by weight of a polar solvent having a water solubility of from about 1 to about 8 g/100 ml wherein the polar solvent is different from the short-chain cosurfactant.

16. The composition of claim 15 wherein the polar solvent is selected from the group consisting of benzyl alcohol, propylene glycol n-butyl ether, n-hexanol, glycol phenyl ethers, and mixtures thereof.

17. The composition of claim 15 further comprising from about 0.1 to about 0.30% by weight, based on the weight of the composition, of a thickening agent selected from the group consisting of hydroxypropyl cellulose, hydroxypropyl methylcellulose, and mixtures thereof.

18. The composition of claim 1 in the form of an oil continuous microemulsion.

19. A spray cleaning composition comprising the composition of claim 1.

20. An oven cleaning composition comprising a composition according to claim 1 having a calculated VOC of less than 80%.

21. A process for cleaning a hard surface comprising contacting the surface with a composition comprising:

(a) from about 1 to about 15% by weight of a primary emulsifier comprising at least one isopropylamine salt of a $C_{10-14}$ alkylbenzenesulfonic acid;

(b) from about 3 to about 50% by weight of a primary solvent selected from one or more dibasic esters;

(c) from about 1 to about 20% by weight of one or more short-chain cosurfactants comprising at least n-butvl ether of a propylene glycol;

(d) from about 1 to about 5% by weight of secondary emulsifier; and (e) the remainder, water to 100%, all weights being based on the total weight of the composition.

22. The process of claim 21 wherein the composition is terpene-free.

23. The process of claim 21 wherein the one or more dibasic esters of the primary solvent are selected from $C_{1-4}$ dialkyl esters of adipic, glutaric, oxalic, malonic, pimelic, suberic or azelaic acids, or mixtures of these acids.

24. A process of claim 23 wherein the one or more dibasic esters are methyl esters.

25. The process of claim 21 wherein the primary solvent is selected from dimethyladipate, dimethyl glutarate, and mixtures thereof.

26. The process of claim 19 wherein the short-chain cosurfactant is propylene glycol n-butyl ether or dipropylene glycol n-butyl ether or a mixture thereof.

27. The process of claim 19 wherein the secondary emulsifier is selected from the group consisting of sodium octyl sulfate, sodium decyl sulfate, sodium lauryl sulfate, alcohol ether sulfates, octyl polyglucoside, decyl polyglucoside, alcohol ethoxylates having HLB values greater than 14, and mixtures thereof.

* * * * *